US007597480B2

(12) United States Patent
Kuge et al.

(10) Patent No.: US 7,597,480 B2
(45) Date of Patent: Oct. 6, 2009

(54) FASTENER BAG

(75) Inventors: Raizo Kuge, Tokyo (JP); Sho Obara, Koshigaya (JP); Yuichi Oki, Tokyo (JP)

(73) Assignees: Hosokawa Yoko Co., Ltd., Tokyo (JP); Idemitsu Unitech Co., Ltd., Tokyo (JP)

( * ) Notice: Subject to any disclaimer, the term of this patent is extended or adjusted under 35 U.S.C. 154(b) by 607 days.

(21) Appl. No.: 10/549,305

(22) PCT Filed: Mar. 17, 2003

(86) PCT No.: PCT/JP03/03152

§ 371 (c)(1),
(2), (4) Date: Nov. 10, 2005

(87) PCT Pub. No.: WO2004/083065

PCT Pub. Date: Sep. 30, 2004

(65) Prior Publication Data

US 2006/0104550 A1 May 18, 2006

(51) Int. Cl.
*B65D 33/00* (2006.01)
*B65D 33/16* (2006.01)
*B65D 30/20* (2006.01)

(52) U.S. Cl. ..... 383/205; 383/61.2; 383/66; 383/120

(58) Field of Classification Search ..... 383/206, 383/63, 204, 61.2, 120, 104, 66, 205
See application file for complete search history.

(56) References Cited

U.S. PATENT DOCUMENTS 2,952,395 A * 9/1960 Spees ..... 383/205
3,127,087 A * 3/1964 Spees ..... 383/205
4,629,071 A * 12/1986 Tani ..... 383/206
4,638,911 A * 1/1987 Prohaska ..... 383/205
4,650,079 A * 3/1987 Tani ..... 383/206
5,104,235 A * 4/1992 Bronstrup et al. ..... 383/120
5,116,140 A 5/1992 Hirashima ..... 383/206
5,375,930 A * 12/1994 Tani ..... 383/206
5,672,009 A * 9/1997 Malin ..... 383/63
5,902,047 A * 5/1999 Yeager ..... 383/63
6,224,262 B1 * 5/2001 Hogan et al. ..... 383/63

(Continued)

FOREIGN PATENT DOCUMENTS

GB 2 341 591 3/2000

(Continued)

*Primary Examiner*—Jes F Pascua
(74) *Attorney, Agent, or Firm*—Steptoe & Johnson LLP

(57) ABSTRACT

There is provided a fastener bag capable of improving working efficiency for the filling of inner content and forming a bag cut-starting portion. The bag is formed as gusset-type packaging bag, to which a fastener for freely opening or closing the packaging bag is attached. The fastener has a male portion to which a projected thread is formed and a female portion to which a groove is formed so as to be engaged with the projected thread. Base portions of the male and female portions are attached to an inner surface of one of the flat surface portions or side surface portions so that the projected thread and the groove face each other. A cut-tape for separating the flat surface portion into the male portion side and the female portion side is provided between the base portions.

7 Claims, 16 Drawing Sheets

U.S. PATENT DOCUMENTS

| | | | | |
|---|---|---|---|---|
| 6,334,710 | B1 * | 1/2002 | Kuge et al. | 383/104 |
| 6,481,183 | B1 * | 11/2002 | Schmidt | 383/63 |
| 6,609,828 | B2 * | 8/2003 | Schneider et al. | 383/204 |
| 6,659,643 | B2 * | 12/2003 | Plourde et al. | 383/66 |
| 2004/0114838 | A1 * | 6/2004 | McGregor | 383/204 |
| 2005/0063624 | A1 * | 3/2005 | Goto et al. | 383/205 |

FOREIGN PATENT DOCUMENTS

| | | |
|---|---|---|
| JP | 1-308754 | 12/1989 |
| JP | 3-56248 | 3/1991 |
| JP | 3-240651 | 10/1991 |
| JP | 9-207948 | 8/1997 |
| JP | 11-321882 | 11/1999 |
| JP | 2000-302725 | 10/2000 |
| JP | 2001-139038 | 5/2001 |
| JP | 2002-104440 | 4/2002 |
| WO | WO 02/22452 | 3/2002 |

* cited by examiner

FASTENER BAG

The present application is based on International Application PCT/JP2003/003152, filed Mar. 17, 2003, which application is incorporated herein by reference in its entirety.

FIELD OF THE INVENTION

The present invention relates to a fastener bag of gusset-type structure which can be easily opened and is provided with a fastener to be freely opened or closed.

BACKGROUND ART

In these days, there is high requirement of producing a packaging bag provided with an easily opening mechanism and a mechanism for freely opening and closing an opening of the opened packaging bag. Specifically, it is required to provide a fastener bag having both functions in a technical field of an automatic filling and packaging bag capable of simultaneously filling a content in the bag and packing the bag.

The applicant of the subject application has provided, in order to satisfy the above requirement, an invention relating to a flat-bag-type fastener bag which is formed with a cut-open portion along an extending direction of a fastener of this fastener bag so as to tear the flat bag in this direction to thereby open the same (Japanese Patent Application No. 2000-302725).

However, in the case of this flat-bag-type fastener bag, a portion from which a content filling hopper is inserted into a bag body is not widened so much, and this matter constitutes an obstacle for improvement of working efficiency. In addition, there may cause a case such that a cutting-starting portion of the cut-open portion, from which the bag is torn and opened, is not well formed.

On the other hand, it has also highly been required to provide a packaging bag having an opening suitably in accordance with kinds of contents to be filled up.

Then, an object of the present invention is to provide a fastener bag surely formed with a cutting-starting portion with an improved working efficiency.

DISCLOSURE OF THE INVENTION

In order to achieve the above object, the present invention provides a fastener bag which comprises a pair of opposed flat surface portions and a pair of side surface portions disposed between both side edges of the flat surface portions, the side surface portions being folded inward so as to provide a gusset-type bag, and in which a fastener for opening or closing the packaging bag is provided to the inner surface thereof, wherein the fastener comprises a male portion having a base portion on one surface side of which a projected thread is formed so as to extend in a longitudinal direction thereof and a female portion having a base portion on one surface side of which an engaging groove detachably engaged with the projected thread is formed so as to extend in a longitudinal direction thereof, the male portion and the female portion are bonded so that the projected thread and the engaging groove face each other in a manner that the one side surface of one of the base portions and the other one side surface of the other one of the base portions are bonded to the one of the flat surface side portions or the one of the side surface portions, and a cut-tape for separating the one of the flat surface portions or the one of the side surface portions to the male portion side and the female portion side is provided between the projected thread and the engaging groove.

According to the present invention mentioned above, the fastener bag can be extremely easily opened by merely pulling the cut-tape with fingers. In addition, in an occasion that inner content filling the faster bag is gradually consumed, the opening portion of the fastener bag can be freely opened and closed, so that the opening portion of the fastener bag, which has once been opened, can be again closed, thus preventing the inner content from being oxidized or like.

On the other hand, when the inner content fills the fastener bag, after a hopper or like is inserted into the upper opening of the bag, the inner content fills, before fusing the upper portion of the fastener bag. According to the fastener bag of the present invention, since the gusset-type packaging bag is employed, the upper opening can be opened widely, thus improving the content filling efficiency.

Moreover, in the fastener bag mentioned above, a pair of the flat surface portions and a pair of the side surface portions constitute a tubular bag body having both ends opened as end openings, one of the end openings of the bag body is closed by a bottom surface portion, and the bottom surface portion provides a flat shape. According to this example, by making flat the bottom surface of the bag, there can be provided a fastener bag having high self-standing performance.

Furthermore, the fastener and the cut-tape mentioned above may be provided so as to extend in a horizontal direction of the fastener bag, in an obliquely inclined direction with respect to an end edge of the flat surface portion or side surface portion to which the fastener and the cut-tape are bonded, or in a vertical direction of the fastener bag. According to such arrangement, the attaching direction of the fastener and the cut-tape can be optionally selected in accordance with the kinds or like of the inner content filling the bag, thus providing a fastener bag in conformity with an object to be utilized.

Furthermore, at the time of attaching the cut-tape, a tab portion for opening the bag at a position corresponding to at least one end in an axial direction of the cut-tape by forming cut-in portions with the end of the cut-tape being the center thereof so as to separate a portion of the cut-tape from the flat surface portion or side surface portion. Therefore, the opening of the fastener bag can be surely started.

Furthermore, in such fastener bag, it may be adopted that the flat surface portion and the side surface portion have boundary portions therebetween, to which fused portions formed by bonding the flat surface portion and the side surface portion are formed, the cut-tape is disposed so that the axial end of the cut-tape reaches the fused portion, and a non-fused portion is formed to the fused portion at a position corresponding to the end of the cut-tape so that a boundary portion between the fused portion and the non-fused portion surround the tab portion.

Still furthermore, in such fastener bag, it may be adopted that the bag body and the bottom surface portion have a boundary portion therebetween, to which fused portions formed by bonding the bag body and the bottom surface portion are formed, the cut-tape is disposed so that the axial end of the cut-tape reaches the fused portion, and a non-fused portion is formed to the fused portion at a position corresponding to the end of the cut-tape so that a boundary portion between the fused portion and the non-fused portion surround the tab portion.

As mentioned above, by forming the boundary portion between the fused portion and the non-fused portion so as to surround the tab portion, it becomes possible to prevent the communication between the inside and the outside of the bag at the tab portion forming portion. In addition, the tab portion is itself not fused, it can be easily thumbed.

Further, the tab portion may be formed in the following two modes.

First, the fused portion is formed such that the non-fused portion surround the periphery of the tab portion, and a portion corresponding to this tab portion is formed as non-fused portion. Then, both side portions of the cut-tape in the width direction are formed so that the positions outside the side edge of the cut-tape from the end edge of the flat surface portion or side surface portion is directed side edge of the cut-tape.

Second, the tab portion may be formed by forming the cut-in portions to the non-fused portion so as to surround the end portion of the cut-tape at the non-fused portion.

BEST MODE FOR EMBODYING THE INVENTION

Hereunder, embodiments of the present invention will be described with reference to the accompanying drawings.

Figure 1:
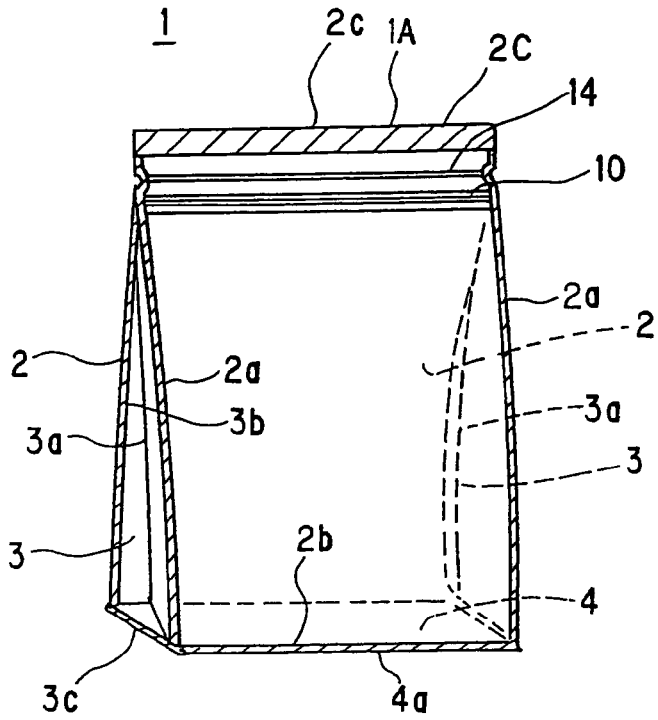
FIG. 1 is a perspective view of a fastener bag according to one embodiment of the present invention.
Figure 2:
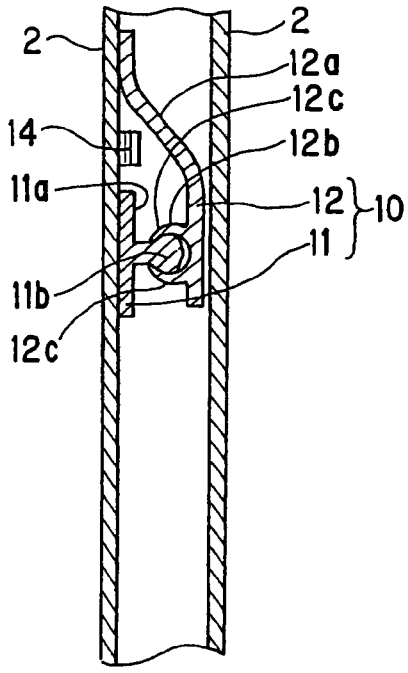
FIG. 2 is an enlarged sectional view of the fastener bag showing an attached state of a fastener for freely opening and closing the fastener bag and a cut tape as seal-opening means.
Figure 3:
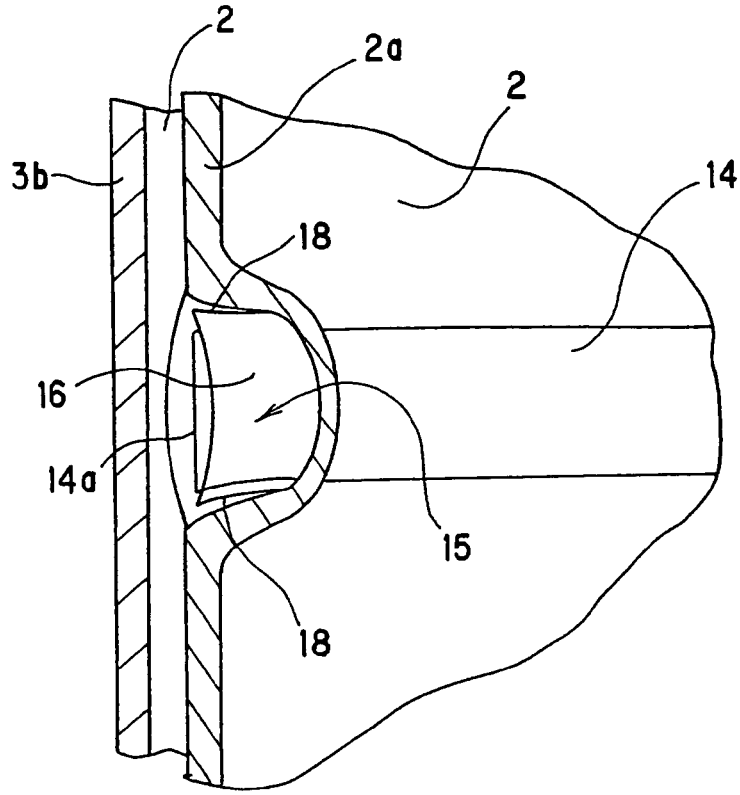
FIG. 3 is a view, in an enlarged scale, of a tab portion formed to a cut-tape end formed to the fastener bag shown in FIG. 1.

FIGS. 1 to 3 show a fastener bag 1 according to one embodiment of the present invention, in which FIG. 1 is a perspective view showing an entire structure of the fastener bag 1, FIG. 2 is an longitudinal sectional view of the fastener bag 1 showing an attached state of a fastener 10 for freely opening or closing the fastener bag 1, and FIG. 3 is an enlarged view showing a seal-opening starting portion of a cut-tape 14 for opening the fastener bag 1.

The fastener bag 1 is formed to have a rectangular shape having a pair of opposing flat surface portions 2, 2, side surface portions 3, 3 positioned at side edge portions 2*a*, 2*a* of the flat surface portions 2, 2, and a bottom surface portion 4 closing a bottom of the fastener bag 1. The fastener bag 1 is formed as a gusset-type packaging bag in which the side surface portions 3, 3 are folded inside along folding lines 3*a*, 3*a* in form of gusset.

In this fastener bag 1, the side edge portions 2*a*, 2*a* of the flat surface portions 2, 2 and side edge portions 3*b*, 3*b* of the side surface portions 3, 3 are fused together, and also, lower end edges 2*b*, 2*b* of the flat surface portion 2, 2 and lower end edge portions 3*c*, 3*c* of the side surface portions 3, 3 are fused to a peripheral edge portion 4*a* of the bottom portion 4. Further, at an upper end of the fastener bag 1, upper end edge portions 2*c*, 2*c* of the flat surface portions 2, 2 are fused together so as to sandwich the inwardly folded side surface portions 3, 3 with the side edge portions 2*a*, 2*a* on both sides of the flat surface portions 2, 2, thus closing an upper portion 1A of the fastener bag 1.

Furthermore, the fastener bag 1 is provided with a fastener 10 for freely re-closing or re-opening, after once opened, the opened portion of the fastener bag 1, and a cut-tape 14 is also provided for the fastener bag 1 so as to be easily opened. The fastener 10 and the cut-tape 14 are attached to one of the flat surface portions 2, thus constituting the fastener bag 1.

The fastener 10 has a finely elongated male portion (or member) 11 and female portion (or member) 12 which can be separated from each other. The male portion 11 has a belt-shaped base portion 11*a* and a linearly projected portion 11*b*, which is hereinafter called "projected thread", projecting from one side surface of the base portion 11*a*. The projected thread 11*b* extends along the longitudinal direction of the base portion 11*a* at the central portion in the width direction thereof. The projected thread 11*b* has a front end (i.e., top end edge) having a circular shape in cross-section as shown in FIG. 2. On the other hand, the female portion 12 has a belt-shaped base portion 12*a* and a groove 12*b* formed to the surface of the base portion 12*a* so that the projected thread 11*b* of the male portion 11 is freely engaged with this groove 12*b*.

The base portion 12*a* of the female portion 12 has a width considerably wider than the width of the base portion 11*a* of the male portion 11. The groove 12*b* has two portions 12*c*, 12*c* forming side wall portions of the groove 12*b* so that the two portions 12*c*, 12*c* project from the surface of the base portion 12*a* and extend in the longitudinal direction thereof at its side end portion. The groove 12*b* has an inner surface having substantially a circular-shape in section so that the front end of the projected thread 11*b* of the male portion 11 is smoothly and surely fitted to the groove 12*b*. The projected thread 11 may have wedge-shape, arrowed-shape or like shape, and in such case, the groove 12 may be formed so as to have its sectional shape in conformity with that of the projected thread 11*b*, such as hook-shape.

The male portion 11 is fused to an upper portion of the fastener bag 1 in a manner such that the base portion 11*a* of the male portion 11 is fused to the inner surface of one of the flat surface portion 2 so as to extend in the longitudinal direction of the base portion 11*a*, i.e., the lateral direction of the fastener bag 1, and the projected thread 11*b* formed to the base portion 11*a* projects toward the inner surface of the other one of the flat surface portion 2. On the other hand, the female portion 12 is attached to the inner surface of the one of the flat surface portion 2 at a portion slightly apart above, by a predetermined distance, from the attaching position of the male portion 11 so as to be in parallel therewith. The female portion 12 is fused to the inner surface of the one flat surface portion 2 so that the groove 12*b* formed to one end side of the base portion 12*a* is opposed to the projected thread 11*b* of the male portion 11.

The cut-tape 14 for opening the fastener bag 1 is bonded to the inner surfaces of one of the flat surface portions 2, 2, on which the fastener 10 is fused, to be in parallel with both the portions 11 and 12 between the fused portion of the base portion 11*a* of the male portion 11 and the fused portion of the base portion 12*a* of the female portion 12. The cut-tape 14 is provided for cutting the flat surface portions 2, 2 so as to separate them to the male and female portion sides, and for this purpose, the cut-tape is formed of a fine elongated belt-shaped material.

FIG. 3 shows a tab portion 16 as a seal-opening starting portion formed to a portion corresponding to the longitudinal end portion of the cut-tape 14. The tab portion 16 is provided by forming cuts 18, 18 to the flat surface portion 2 from the side end thereof along the cut-tape 14 at both side portions in the width direction of the cut-tape 14. As mentioned above, the flat surface portions 2, 2 and the side surface portions 3, 3 are fused at the side edge portions 2*a* and 3*b* of them, but the tab portion 16 is not fused and a portion surrounding the tab portion is fused, so that the portion at which the tab portion 16 exists is formed as non-fused portion 15 of both the side edge portions 2*a* and 3*b* at a portion near the tab portion 16. Therefore, the tab portion 16 is separated from the other portion of the flat surface portion 2 to be capable of thumbing this portion 16 with fingers.

When it is required to open the fastener bag 1, the tab portion 16 is thumbed together with the end portion 14*a* of the cut-tape 14, and then, the cut-tape 14 is pulled toward the other end side of the fastener bag 1 or in a direction apart from the fastener bag 1. In this operation, the cut-tape serves as bag cutting means, the flat surface portion 2 is cut along the cut-tape 14, and the attached side of the male portion 11 and the attached side of the female portion 12 are separated from each other.

As mentioned above, the tab portion 16 serves as the seal-opening starting portion to make easy the opening of the fastener bag 1.

Figure 4:
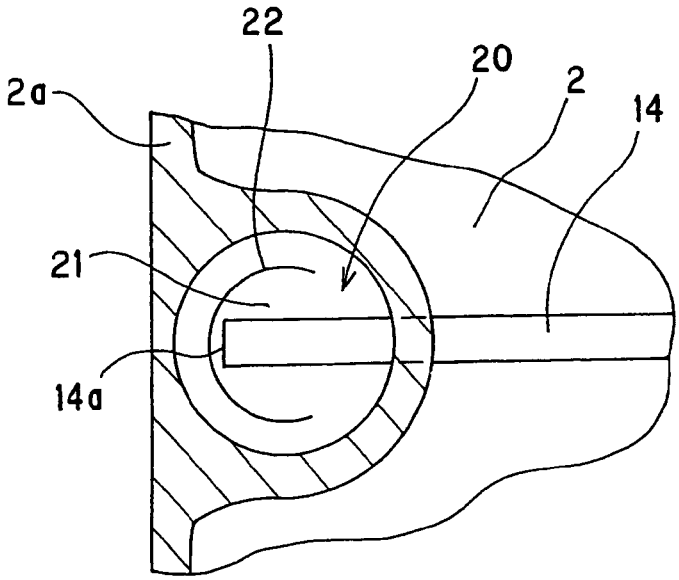
FIG. 4 is a view, in an enlarged scale, of a tab portion different from that shown in FIG. 3.

FIG. 4 shows another example of the tab portion 21. At a portion corresponding to the end 14*a* of the cut-tape 14, a portion surrounding the end of the cut-tape 14 so as to form a circular non-fused portion 20. The circular non-fused portion 20 is formed with a circular-arc-shaped cut 22 so as to surround the end of the cut-tape 14. The inner side portion of this cut 22 forms the tab portion 21. Since this tab portion 21 is also not fused, this portion can be pulled up to be separated from the other portion of the flat surface portion 2, and then, the tab portion 21 can be thumbed together with the end of the cut-tape 14 inside the tab portion 21.

In order to open the sealing of the fastener bag 1, as like as the case of the tab portion 16 shown in FIG. 3, the tab portion 21 can be thumbed together with the end of the cut-tape 14, and then, the cut-tape 14 is pulled toward the other end side of the fastener bag 1 or in a direction apart from the fastener bag 1.

In either one of the examples shown in FIG. 3 and FIG. 4, the tab portion 16 or 21 may be formed to one of the side end portions of the fastener bag 1 or to both the side end portions thereof. Further, the present invention is not limited to the examples in which the tab portions 16 and 21 are formed by forming cuts 18 and 22 to the flat surface portions 2, and these tab portions 16 and 21 may be formed in other ways as far as the tab portions can be separated from the other portion thereof.

The film material for forming the body of the fastener bag 1 and the cut-tape 14 may be formed of material or materials which are explained hereunder.

In a case where the fastener bag 1 having transparency is formed, the following laminate films may be adopted as the film material: a laminated film formed by laminating a biaxial oriented polypropylene film having thickness of 20 to 50 μm and a non-oriented polypropylene film having thickness of 20 to 60 μm with a dry bonding layer having thickness of 2 to 3 μm; a laminated film formed by laminating a polyester film having thickness of 9 to 25 μm and a straight chain low-density polyethylene film having thickness of 25 to 120 μm with a dry bonding layer having thickness of 2 to 3 μm; and a laminated film formed by laminating a biaxial oriented nylon film having thickness of 9 to 20 μm and a polyethylene film having thickness of 25 to 120 μm with a dry bonding layer having thickness of 2 to 3 μm. Further, the bonding layer is not limited to the dry bonding layer, and a polyethylene extruded layer having thickness of 12 to 20 μm may be employed.

On the other hand, in a case where the fastener bag 1 having opacity is formed, the following laminate films may be adopted as the film material: a laminated film formed by laminating a polyester film having thickness of 9 to 25 μm, an aluminium foil having thickness of 6 to 30 μm, and a straight chain low-density polyethylene film having thickness of 25 to 120 μm with a dry bonding layer having thickness of 2 to 3 μm; and a laminated film formed by laminating a polyester film having thickness of 9 to 25 μm, an evaporated polyester film having thickness of 12 μm and a non-oriented polypropylene film having thickness of 20 to 60 μm with a dry bonding layer having thickness of 2 to 3 μm. Further, the bonding layer is not limited to the dry bonding layer, and a polyethylene extruded layer having thickness of 12 to 20 μm may be employed.

In the meantime, the cut-tape 14 employs a three-layer structure of a straight chain polyethylene layer, a polyester layer and an release layer. The release layer is formed from a chlorinated polypropylene, an EVA or hot-melt layer so as to provide a peel strength of about 200 g/cm. Further, as the packaging material forming the packaging bag body of the fastener bag 1, a material having a cut strength higher than the peel strength of the release layer of the cut-tape 14 will be employed.

The cut-tape 14 may employ: a four-layer structure of low-density polyethylene layer, polyester layer, low-density polyester layer and release layer; a four-layer structure of straight chain low-density polyethylene layer, polyester layer, straight chain low-density polyethylene layer and release layer; a four-layer structure of ultra low-density polyethylene layer, polyester layer, ultra low-density polyester layer and release layer; and a four-layer structure of cast polypropylene layer, polyester layer, cast polypropylene layer and release layer.

According to the fastener bag 1 having the structures mentioned above, when it is required to fill a content in the fastener bag 1, the opening portion of the packaging bag can be widely opened to thereby effectively fill the content. Moreover, since the gusset-type packaging bag is adopted, the fastener bag 1 can be provided with widened width in its thickness direction (i.e., a width direction between the front and back surfaces) to thereby increase an inner volume for the content to be filled therein.

In addition, since the gusset-type packaging bag is adopted, it is possible to fold the fastener bag 1 in its thickness direction when the inner content is consumed and remains in less amount, and hence, it is possible to accommodate the fastener bag 1 in a narrow space.

Hereunder, there will be explained a manufacturing method of one example of the fastener bag 1 in which the packaging materials for respectively forming the flat surface portions 2, 2 and the side surface portions 3, 3 are prepared separately, which are then fused together to form a packaging bag, to which a tab portion 16 is formed as shown in FIG. 3.

Figure 5:
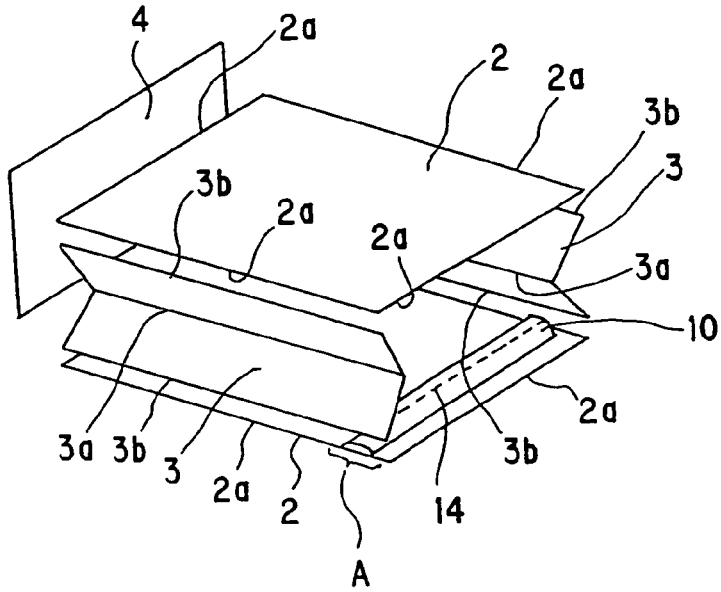
FIG. 5 is a developed view for explaining one step of a method of manufacturing the fastener bag shown in FIG. 1.

As shown in FIG. 5, the following packaging materials are prepared: a packaging material for forming a pair of flat surface portions 2, 2, each cut in a rectangular shape; a packaging material for forming a pair of side surface portions 3, 3, each cut in a rectangular shape; and rectangular packaging material for forming the bottom portion 4 of the fastener bag 1. Folding lines are formed to the packaging material for forming the side surface portions 3, 3 along their central portions so as to be folded into two parts.

Figure 6:
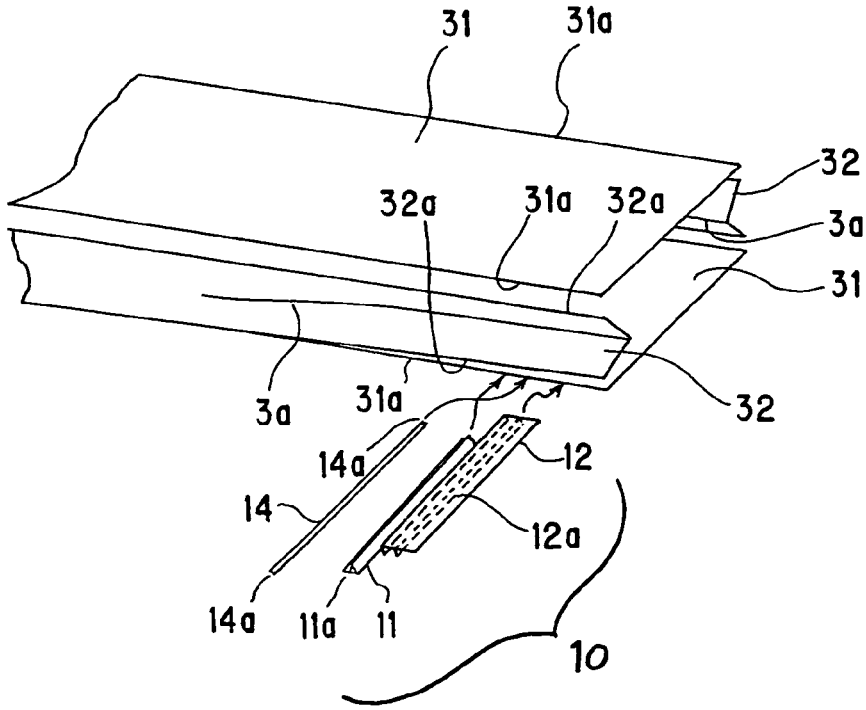
FIG. 6 is a developed view for explaining one step, different from that of FIG. 5, of a method of manufacturing the fastener bag shown in FIG. 1.

Next, as shown in FIGS. 5 and 6, the base portion 11*a* of the male portion 11 constituting the fastener 10 is fused to a portion A near one side forming the peripheral edge of the packaging material forming one of the flat surface portions 2, and the base portion 12*a* of the female portion 12 is then fused to the same flat surface portion 2 a predetermined distance from the male portion 11. Concerning the male portion 11, its base portion 11*a* is fused to a portion slightly inside the peripheral edge 2*a* of the packaging material so as to be parallel with the peripheral edge 2*a*. On the other hand, concerning the female portion 12, its base portion 12*a* is fused to a portion between the male portion 11 and the peripheral edge of the packaging material so as to be parallel with this peripheral edge and the male portion 11. In such fusing operation, the base portion 12*a* of the female portion 12 is fused to the packaging material on the same surface as that on which the groove 12*b* is formed. Accordingly, the groove 12*b* of the female portion 12 and the projected thread 11*b* of the male portion 11 are arranged to be opposed to each other.

In addition, the cut-tape 14 for opening the packaging bag is bonded at substantially the central position between the portion to which the base portion 11*a* of the male portion 11 and the portion to which the base portion 12*a* of the female portion 12 is fused. In this operation, the cut-tape 14 is bonded so as to extend in the width direction of the flat surface portion 2 in parallel with the male portion 11 and the female portion 12.

After the completion of the above-mentioned process, two sheets of packaging material constituting the side surface portions 3, 3, one sheet of packaging material constituting one of the flat surface portions 2 to which the fastener 10 and the cut-tape 14 are attached, and one sheet of packaging material constituting the other one of the flat surface portions 2 to which any other member or like is not attached are fused together to thereby form a tubular body. During the step for forming such tubular body, the folding lines 3*a*, 3*a* are positioned to be directed inward the tubular body so that the packaging material constituting the side surface portions 3, 3 are to be folded inward toward the center of the tubular body, and both side edges thereof are respectively fused to the side edges of both the packaging material constituting the flat surface portions 2, 2. According to such forming processes, there is provided the tubular body having a pair of flat surface portions 2, 2 opposed to each other and a pair of side surface portions 3, 3 folded inward along the folding lines 3*a*, 3*a*, respectively.

Further, in the case of fusing the packaging materials together, the other one flat surface portion 2 to which any one of members or like is not attached and the side surface portions 3, 3 are continuously fused linearly along with the side edges thereof 2*a* and 3*a*. On the other hand, the one flat surface portion 2 to which the fastener 10 and the cut-tape 14 are attached is fused to the side surface portions 3, 3 in a manner such that both the end portions 14*a*, 14*a* of the cut-tape 14 are fused in the circular-arc shape so that non-fused portions 15 remain to portions at which both end portions of the cut-tape 14 are positioned. As a result, both end portions 14*a*, 14*a* of the cut-tape 14 are surrounded at their peripheral portions by the fused portions each in the circular arc shape.

In the next step, both side portions in these non-fused portions 15 in the width direction of the cut-tape 14 are cut in by a predetermined length along the longitudinal direction of the cut-tape 14. These cut-in portions constitute the tab portions 16 for the seal-opening starting portion.

Hereinabove, there was described the case in which the tubular body is formed by using the packaging materials, preliminarily cut in predetermined dimensions, forming the fastener bag 1 of the present invention. When mass-production of the fastener bag 1 is required, belt-shaped packaging materials 31 and 32 shown in FIG. 6 may be utilized as packaging materials constituting the flat surface portions 2, 2 and the side surface portions 3, 3. That is, the packaging materials 31, 31 constituting the flat surface portions 2, 2 are conveyed in the longitudinal direction. On the other hand, the packaging materials 32, 32 constituting the side surface portions 3, 3 are also conveyed in their longitudinal direction in an opposed manner between both the packaging materials 32, 32 at the positions corresponding to the sides of the packaging materials 31, 31 constituting the flat surface portions 2, 2, respectively. The packaging materials 32, 32 constituting the side surface portions 3, 3 are folded, during their conveying process, so that the folding lines 3*a*, 3*a* are formed to the central portions in the width direction thereof. In this process, the packaging materials 31, 31 are folded such that the folding lines 3*a*, 3*a* are directed toward the central portion of the packaging materials 31, 31 constituting the flat surface portions 2, 2.

A set of male and female portions 11 and 12 forming the fastener 10 is subsequently conveyed from its side portion toward the surface side of the packaging material 31 constituting the one flat surface portion 2 opposing to the other one flat surface portion 2 and then fused at every predetermined interval in the longitudinal direction of the packaging material 31. This fusing is performed, as mentioned above, such that the base portions 11*a* and 12*a* of both the male and female portions 11 and 12 are arranged to be parallel with each other at the portions with the predetermined space in the longitudinal direction of the packaging material. Likely, the cut-tape 14 is also conveyed toward the packaging material 31 from the side portion thereof, and the cut-tape 14 is then bonded to substantially the central position between the fused portions of both the base portions 11*a* and 12*a* of the male and female portions 11 and 12 to be parallel with these parts 11 and 12.

Thereafter, the both side edge portions 31*a*, 31*a* of the packaging materials 31, 31 constituting the flat surface portions 2, 2 are respectively fused to both side edge portions 32*a*, 32*a* of the packaging materials 32, 32 constituting the side surface portions 3, 3, thus forming the tubular body. When the packaging materials 31 and 32 together, the cut-tape 14 is fused by avoiding in circular-arc shape so that both the end portions thereof remain as non-fused portion 15. Thereafter, the cut-in portion having a predetermined length is formed in this non-fused portion 15 from the side of the tubular body.

Then, the position apart, by a predetermined distance, from the portion, to which the base portion 12*a* of the female portion 12 is fused, is cut subsequently in the direction normal to the longitudinal direction of the tubular body, thus forming the tubular body having the length corresponding to the one fastener bag 1.

As seen in FIG. 5, a packaging material constituting the bottom portion 4 is attached to the lower end portion of the tubular body, thus providing a packaging bag having an opened upper end. As the packaging material constituting the bottom portion 4, a rectangular packaging material having approximately the same dimension of the cross surface of the tubular body, and the peripheral edge of this packaging material is fused to the lower end edge of the tubular body, thus forming the packaging bag.

Figure 7:
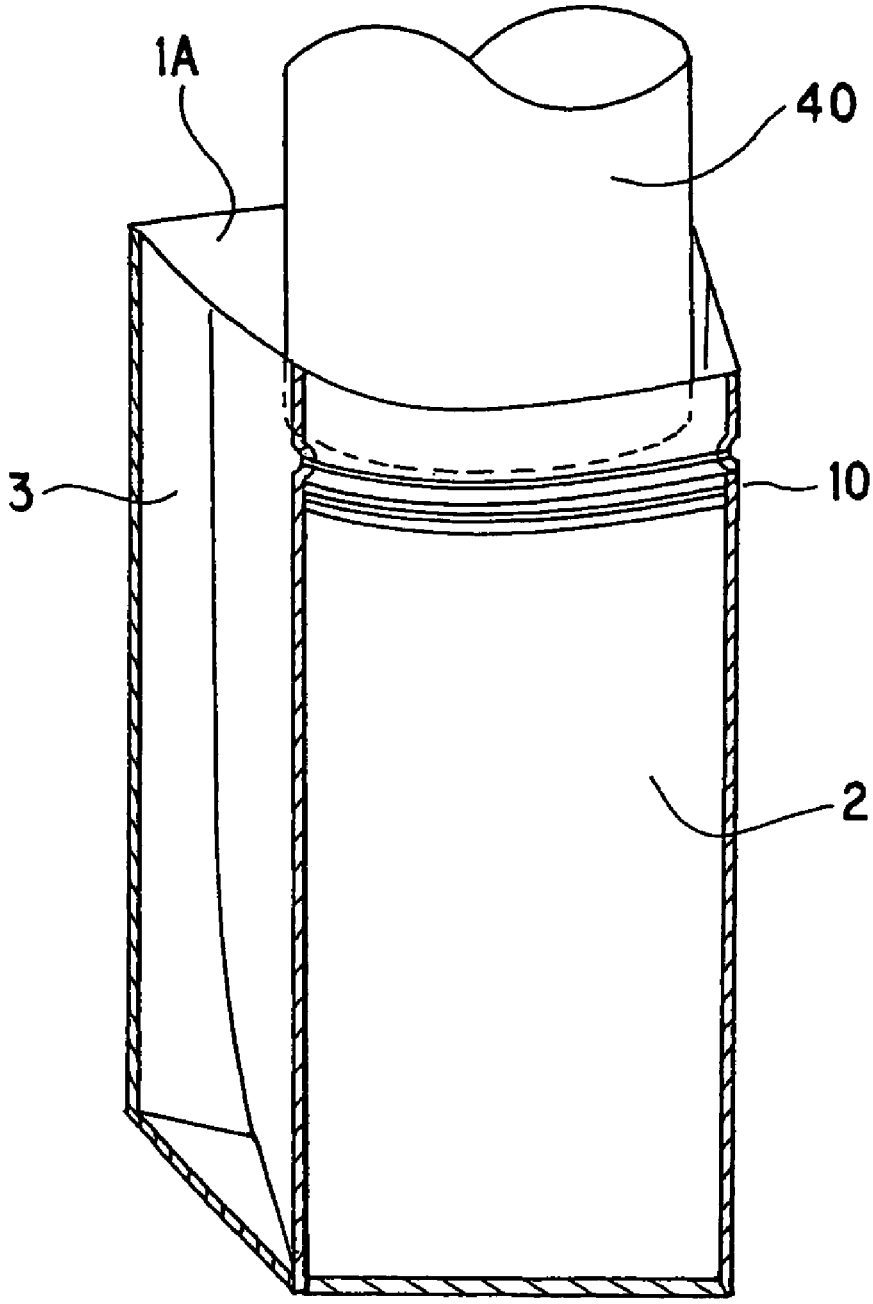
FIG. 7 is a view showing a process of containing a content into the fastener bag.

Thereafter, as shown in FIG. 7, a hopper 40 for filling the content into the packaging bag is inserted into an upper portion 1A of the opened packaging bag, thus filling the content therein. Since this fastener bag 1 has the gusset-type side surface portions 3, 3, the opening of the bag body is widely opened, and hence, the hopper can be extremely easily inserted into the packaging bag through the opening formed to the upper portion thereof. The upper end edge 1A of the packaging bag is then fused, thus completing the fastener bag 1.

Figure 8:
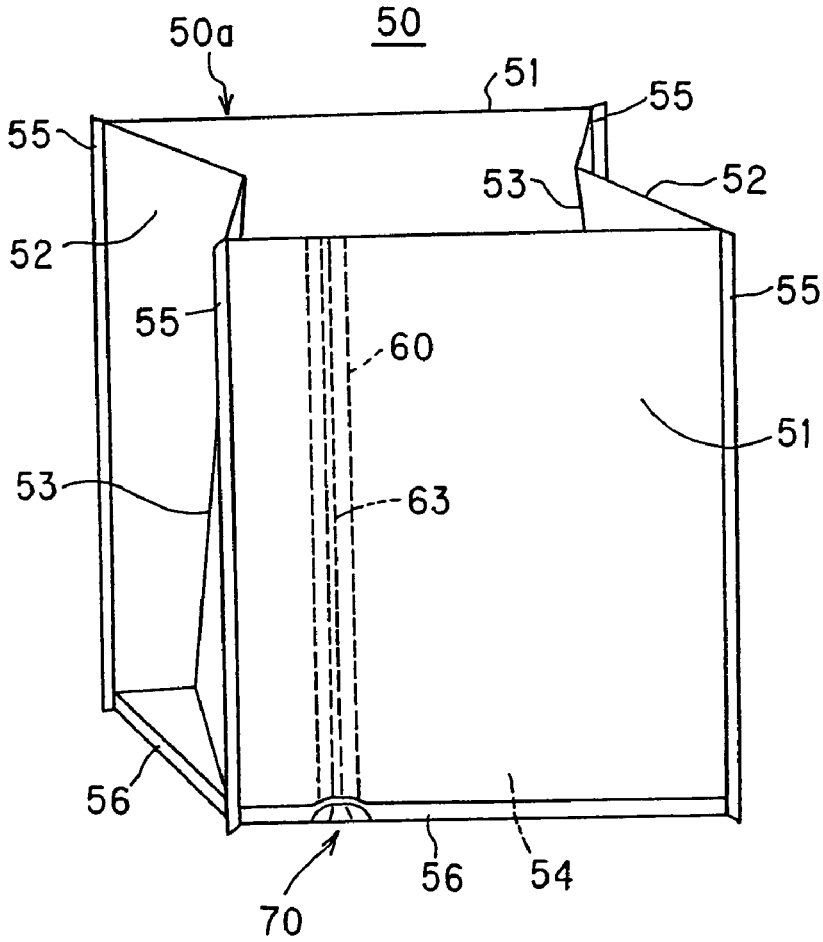
FIG. 8 is a perspective view of a fastener bag in which a fastener is mounted to a flat surface portion so as to extend in a vertical direction.

FIG. 8 shows a perspective view of a fastener bag 50 according to another embodiment of the present invention.

The fastener bag 50 shown in FIG. 8 is provided with a bag body 50*a* having a pair of opposed flat surface portions 51, 51, and a pair of side surface portions 52, 52, which are disposed between side edge portions of both the flat surface portions 51, 51.

The bag body 50*a* has a tubular structure which is formed by fusing the side edges of the flat surface portions 51, 51 and the side edges of the side surface portions 52, 52, resulting in fused edges 55. The flat surface portions 51, 51 are formed from rectangular films, respectively, and the side surface portions 52, 52 have folding lines 53, 53 formed at the central portion in the thickness direction (i.e., width direction of the side surface portion) toward the inside of the bag body 51*a*.

The fastener bag 50 has a flat bottom surface portion 54 formed by closing one of the end openings of the bag body 51*a*. This bottom surface portion 54 is formed from a rectangular film material, and a peripheral edge portion of the bottom surface portion 54 is fused to this one of the openings, resulting in fused edge 56.

A fastener 60 is attached to the inner surface of one of the flat surface portions 51 constituting the fastener bag 60 so as to extend vertically of the bag body 51*a*. This fastener 60 is composed of a male portion 61 and a female portion 62 to be separable from each other. Furthermore, a cut-tape 63 in form of belt is bonded to the flat surface portion 51 between the male and female portions 61 and 62 to be parallel with the fastener 60.

The male portion 61 is composed of a belt-shaped base portion 61*a* and a projected thread 61*b* projecting from one surface side of the base portion 61*a*, and on the other hand, the female portion 62 has a belt-shaped base portion 62*a* and a groove 62*b* formed to the surface of the base portion 62*a* so that the projected thread 61*b* of the male portion 61 is freely engaged with this groove 62*b*. The projected thread 61*b* is formed, so as to extend along the longitudinal direction of the base portion 61*a* at substantially the central portion in the width direction of the base portion 61*a*. The projected thread 61*b* has a front end, i.e., top end edge, providing a circular-arc shape in cross section.

On the other hand, the base portion 62*a* of the female portion 62 is formed from a material having a width wider than that of the base portion of the male portion 61. The groove 62*b* has two portions 62*c*, 62*c* constituting side walls of the groove 62 in a manner projecting over the surface of the base portion 62*a* so as to extend in the longitudinal direction at a portion near the side end of the base portion 62*a*. The groove 62*b* has an inner surface in form of circular-arc shape in cross section, and the front end of the projected thread 61*b* formed to the male portion 61 is smoothly and surely engaged with the groove 62*b* of the female portion 62.

The male portion 61 is attached in a manner such that a surface of its base portion 61*a* opposite a surface on which the projected thread 61*b* is formed, is fused to one of the flat surface portions 51 so as to extend in the vertical direction of the fastener bag 50 and so that the projected thread 61*b* formed to the base portion 61*a* projects toward the other flat surface portion 51. On the other hand, the female portion 62 is attached to the inner surface of the one flat surface portion 51 separated by a predetermined distance from the attaching position of the male portion 61 to be parallel therewith. This female portion 62 is fused to the inner surface of the flat surface portion 51, so that the groove 62*b* formed to one end side in the width direction of the base portion 62*a* is opposed to the projected thread 61*b* of the male portion 61, at the other end side in the width direction of the same surface as that on which the groove 62*b* is formed.

The cut-tape 63 for opening the fastener bag 50 is bonded to the inner surface of the one flat surface portion 51 on which the fastener 60 is fused, to be parallel with both the parts 61 and 62 between the fused portions of the base portions 61*a* and 62*a* of the male and female portions 61 and 62. The cut-tape 63 is a tape for cutting the flat surface portion 51 into male side portion 61 and female side portion 62, and is formed from a fine belt-shaped material.

Figure 10:
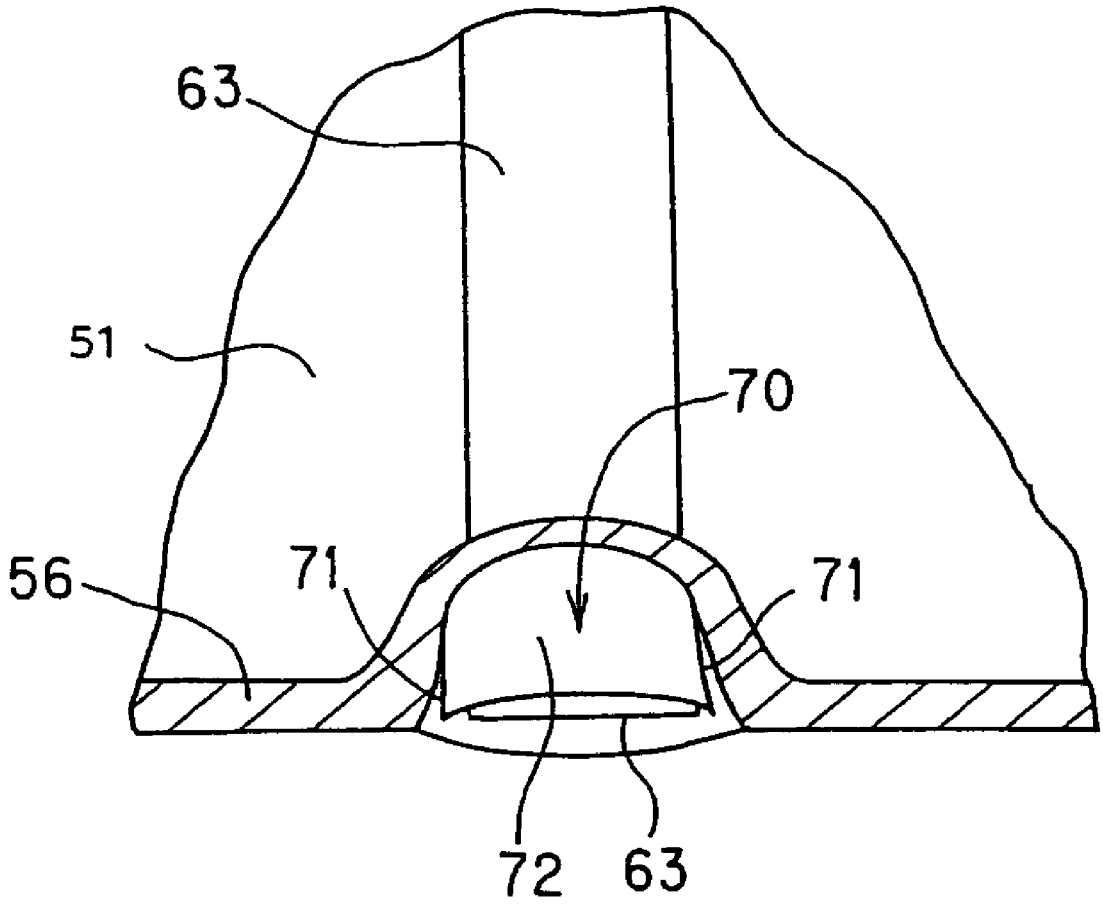
FIG. 10 shows one example of a tab portion.

Further, as shown in FIG. 10, a tab portion 72 for gripping the end portion of the cut-tape 63 is formed to the lower end of the fastener bag 50. The fused portion 56 of the flat surface portion 51 and the bottom surface portion 54 are partially not fused together as non-fused portion 70 at the position corresponding to the end portion of the cut-tape 63 forming the tab portion 72. This non-fused portion 70 has substantially a circular-arc shape so as to surround the end portion of the cut-tape 63. The flat surface portion 51 corresponding to the non-fused portion 70 is cut so as to form cut-in portions 71, 71 along the cut-tape 63 at the side edge portions thereof in slightly tapered shape from the lower end portion. The tab portion 72 is the portion formed between these cut-in portions 71, 71. Accordingly, the tab portion 72 is separated from the other portions of the flat surface portion 51 so as to be capable of being gripped with fingers.

Although FIG. 8 shows an example in which the fastener 60 and the cut-tape 63 are formed to the left side of the flat surface portion 51, the present invention is not limited to such example and they may be formed to the central portion or right side of the flat portion as far as they extend vertically.

Figure 11:
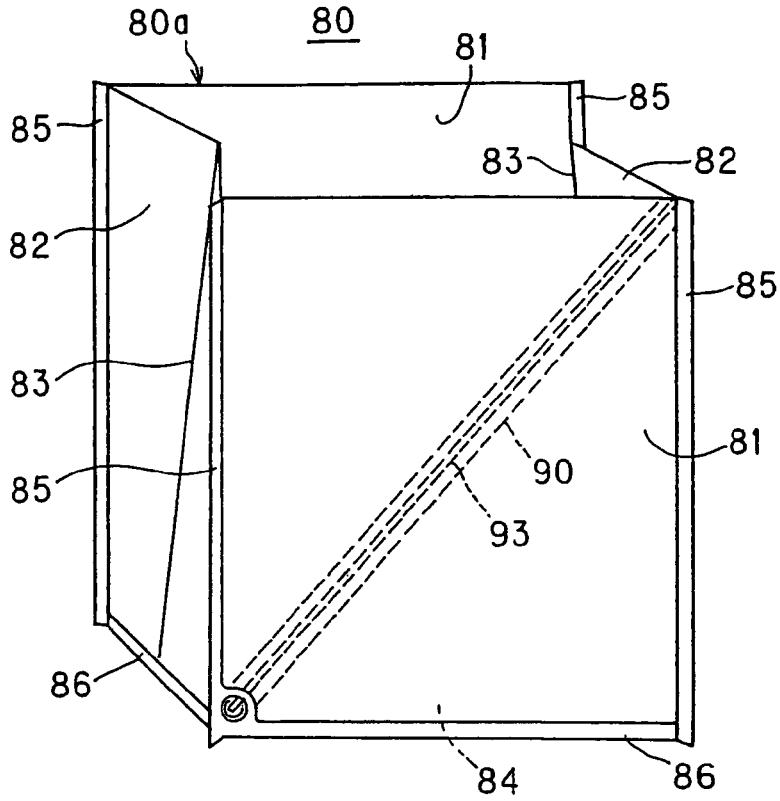
FIG. 11 is a perspective view of a fastener bag in which a fastener is mounted in a diagonal direction of a flat surface portion of the fastener bag.

FIG. 11 shows a perspective view of a fastener bag 80 according to a further embodiment of the present invention. This fastener bag 80 shown in FIG. 11 is also provided with a bag body 80*a* having a pair of opposed flat surface portions 81, 81, and a pair of side surface portions 82, 82, which are disposed between side edge portions of both the flat surface portions 81, 81. The side surface portions 82 may be fused with the flat surface portions 81 alone fused portions 86. The bag body 81*a* has a flat bottom surface portion 84 formed by closing one of the end openings of the bag body 81*a*. The side surface portions 82 and flat surface portions 81 may be fused with the bottom surface portion 84 at fused portion 86. The side surface portions 82, 82 are formed with folding lines 83, 83 to be folded inward.

A fastener 90 is attached to the inner surface of one of the flat surface portions 81 constituting the fastener bag 80 so as to extend in a diagonal direction on the flat surface portion 81 of the bag body 81*a*. This fastener 90 is composed of a male portion (not shown) and a female portion (not shown) to be separable from each other. Furthermore, a cut-tape 93 in form of belt is bonded to the flat surface portion 81 between the male and female portions to be parallel with the fastener 90. The structure of the fastener 90 is substantially identical to that shown in FIGS. 2 and 9, so that the explanations thereof are omitted herein.

Figure 12:
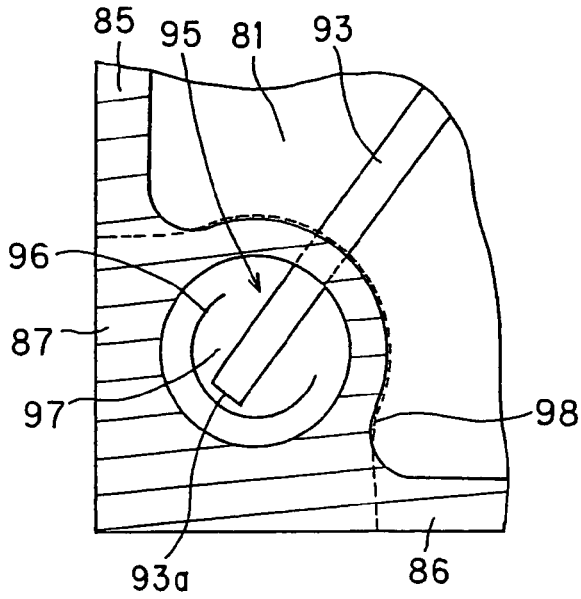
FIG. 12 shows another example of a tab portion.

As shown in FIG. 12, at a left side corner portion of the fastener bag 80, a tab portion 97 for thumbing the end of the cut-tape 93 with fingers is formed. On this corner portion, a sector-shape sheet, as shown with dotted line, is bonded so as to cover an end portion of the cut-tape 93*a* from the inner surface side of the flat surface portion 81. In this corner portion, a non-fused portion 95 is formed at a position corresponding to the end portion of the cut-tape 93 in a common (or mixed) fused portion 87 of the fused portion 85 and fused portion 86. This non-fused portion 95 has a circular shape so as to surround the end portion 93*a* of the cut-tape 93, and a circular cut-in portion 96 is formed to the flat surface portion 91 of the non-fused portion 95 so as to surround the cut-tape 93. A tab portion 97 is formed inside this cut-in portion 96. According to such structure, the tab portion 97 is formed to be separable from the other portion of the flat surface portion 81 and capable of being thumbed with fingers. In addition, since this corner portion is bonded with the sheet 98 from the inside thereof, leakage out of the inner content therefrom can be prevented.

Figure 13:
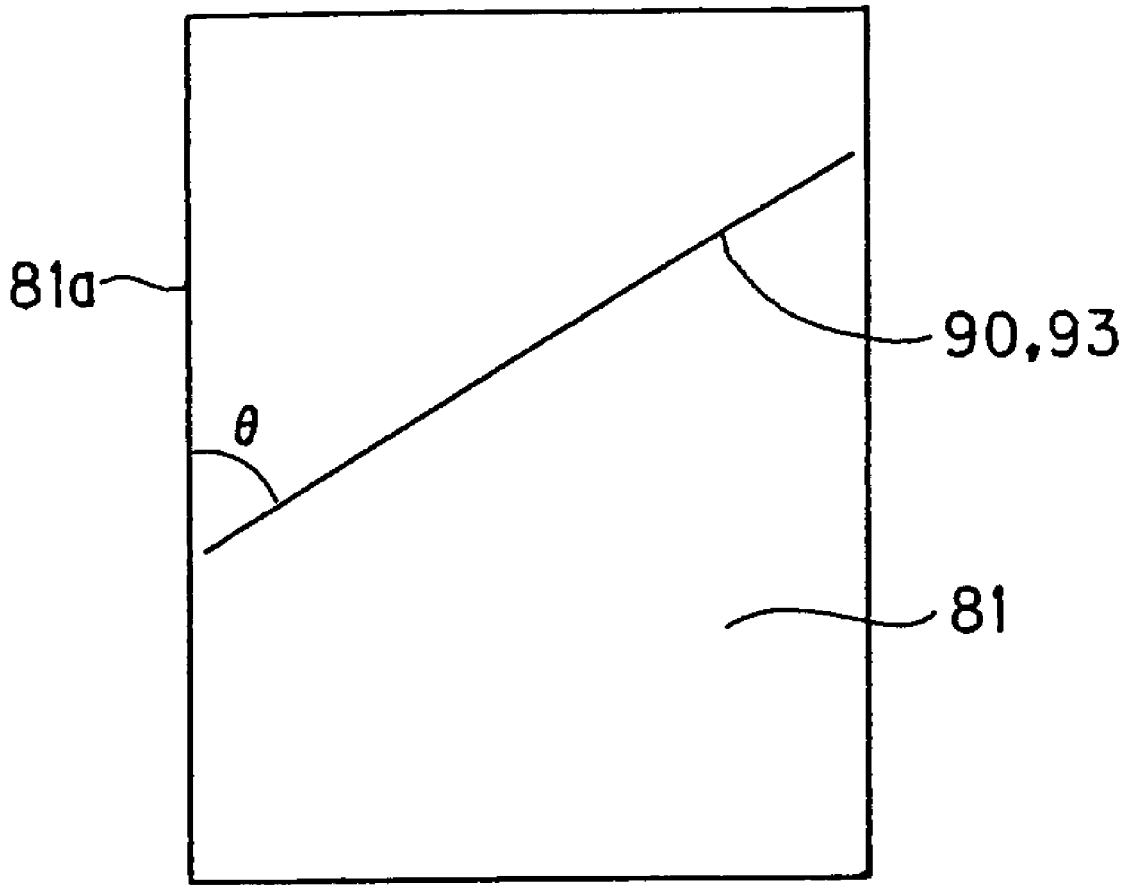
FIG. 13 is a view for explaining fastener and cut-tape attaching direction.

Although FIG. 11 and FIG. 12 show the embodiment in which the fastener 90 and the cut-tape 93 extend on the diagonal direction on the flat surface portion 81, the present invention is not limited to this embodiment, and as shown in FIG. 13, any other embodiment may be adopted as far as the fastener 90 and the cut-tape 93 constitute a predetermined angle θ with respect to the end edge 81*a* of the flat surface portion 81.

Figure 14:
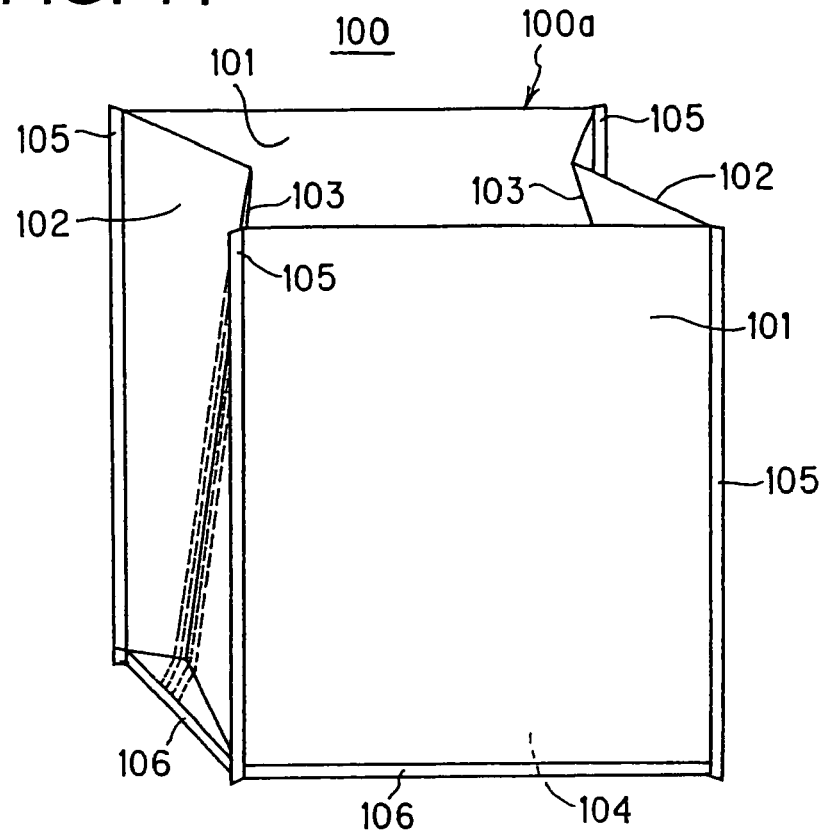
FIG. 14 is a perspective view of a fastener bag in which a fastener is attached to a side surface portion thereof.
Figure 15:
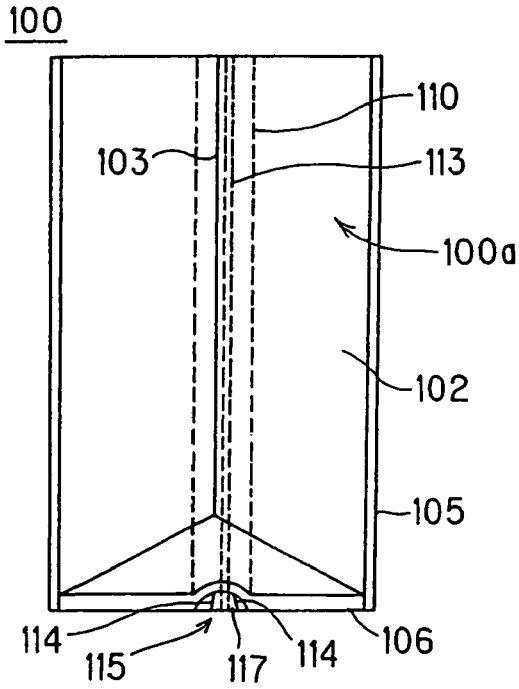
FIG. 15 is a side view of the fastener bag shown in FIG. 14.

FIG. 14 and FIG. 15 represent a fastener bag 100 according to a further embodiment of the present invention. This fastener bag 100 shown in FIG. 14 and FIG. 15 is also provided with a bag body 100*a* having a pair of opposed flat surface portions 101, 101, and a pair of side surface portions 102, 102, which are disposed between side edge portions of both the flat surface portions 101, 101. The bag body 101*a* has a flat bottom surface portion 104 formed by closing one of the end openings of the bag body 101*a*. The side surface portions 102, 102 are formed with folding lines 103, 103 to be folded inward.

The side surface portions 102 and flat surface portions 101 may be fused at fused portion 105. The side surface portions 102 and flat surface portions 101 may be fused to the flat bottom surface portion 104 at fused portions 106.

A fastener 110, composed of a male portion and a female portion, is attached to the inner surface of one of the side surface portions 102 constituting the fastener bag 100 so as to extend vertically along the folding line 103 at the central portion of the side surface portion 102. The structure of the fastener 110 is substantially identical to that shown in FIGS. 2 and 9, so that the explanation thereof is omitted herein. Furthermore, a cut-tape 113 in form of belt is bonded to this side surface portion 102 between the male and female portions to be parallel with the fastener 110.

In the fastener bag 100 of this embodiment, a tab portion 117 is formed to the lower end of the side surface portion 102. The fused portion 106 of the side surface portion 102 and the bottom surface portion 104 are not partially fused together as non-fused portion 115 at the position forming the tab portion 117. The tab portion 117 at this non-fused portion 115 is formed by forming cut-in portions 114, 114 to the side surface portion 102 at the outward portion from the side edge thereof. Further, in the case where the fastener and the cut-tape are formed to the side surface portion 102, the present invention is not limited to the example in which they extend vertically as shown in FIG. 14 and FIG. 15.

Figure 16:
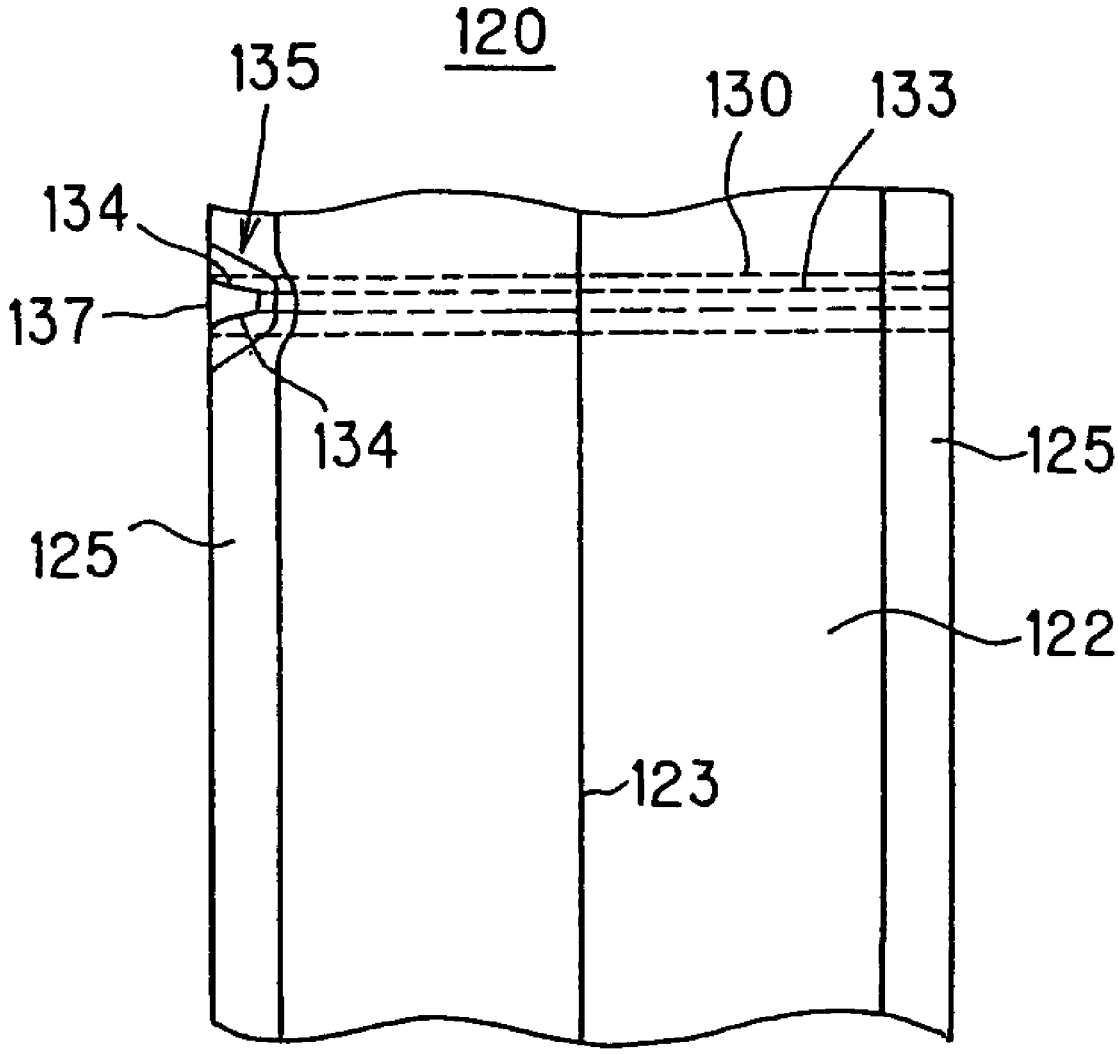
FIG. 16 is a view showing a side surface portion of a fastener bag on which a fastener is attached so as to extend horizontally.

FIG. 16 represents an embodiment of a fastener bag 120 in which a fastener 130 and a cut-tape 133 are attached, so as to extend in the horizontal direction of the fastener bag 130, to a side surface portion 122 having a folding line 123. In this embodiment shown in FIG. 16, the fastener 130 and the cut-tape 133 are attached to the side surface portion so as to extend in the thickness direction of the fastener bag 130. A tab portion 137 is formed to a fused portion 125 of a back surface portion as one of the flat surface portion and the side surface portion 122.

At the position to which this tab portion 137 is formed, a non-fused portion 135 is formed to the fused portion 125 so as to provide a circular-arc shape, and cut-in portions 134, 134 are formed at the outside portions of the side edge of the side surface portion 122 so as to correspond to the end of the cut-tape 133. The tab portion 137 is positioned between these cut-in portions 134, 134.

Hereinabove, although embodiments or examples of the fastener bags which are formed by fusing the flat surface portions, side surface portions and bottom surface portion which are separately prepared, the present invention may be applied to various embodiments or examples other than the above, which will be explained hereunder.

Packaging bags shown in FIGS. 17 to 25 are ones each formed from a single sheet film having end edges which are fused so as to provide a tubular body, and thereafter, a packaging bag is formed.

Figure 17:
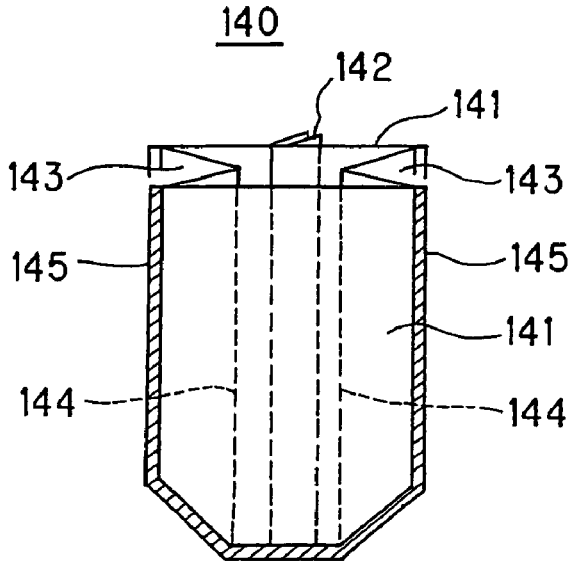
FIG. 17 shows one example of a packaging bag to which the present invention is applicable.
Figure 18:
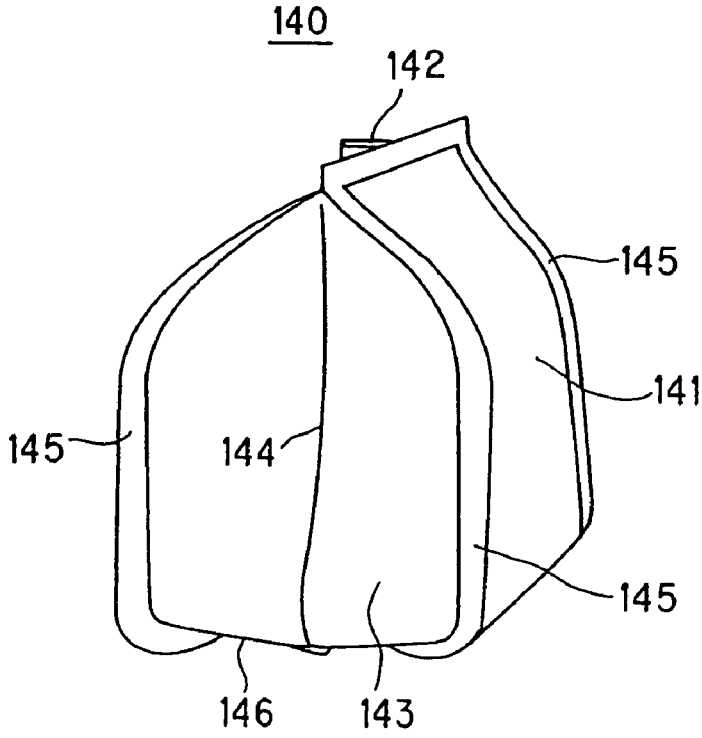
FIG. 18 is a perspective view showing a self-standing condition of the packaging bag shown in FIG. 17.

One example thereof is shown in FIG. 17 and FIG. 18. A packaging bag 140 has, as shown in FIG. 17, a hexagonal structure including a pair of opposed flat surface portions 141, 141 and a pair of side surface portions 143, 143 which are positioned between the side edge portions of the flat surface portions 141, 141. A fused portion 142 formed by bonding a sheet of film is provided, so as to project outward, to a back surface portion 141 forming one of the flat surface portions 141, 141. Folding lines 144, 144 are also formed to the central portions of the side surface portions 143, 143 to be directed inward of the packaging bag 140. Fused portions 145 are further formed to boundary portions between the peripheral edge portions of the flat surface portions 141, 141 and the side surface portions 143, 143.

FIG. 18 shows the packaging bag 140 in the self-standing state after an inner content has been accommodated and the opening of the bag has been then sealed. In this standing state, lower portions of the flat surface portions 141, 141 and the side surface portions 143, 143 are folded so as to provide flat portions. These flat portions form a bottom surface portion 146. Further, the fused portions 145 formed to the boundary portions between the flat surface portions 141, 141 and the side surface portions 143, 143 function as support columns, thus improving the self-standing property.

Figure 19A:
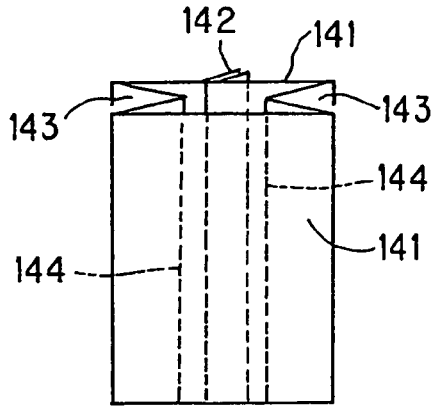
FIGS. 19A-C include views explaining a manufacturing method of the packaging bag as shown in FIG. 17.
Figure 19B:
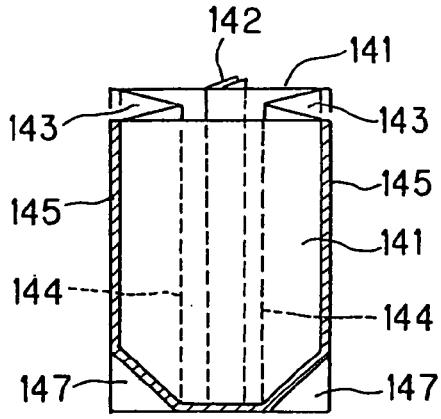
Figure 19C:
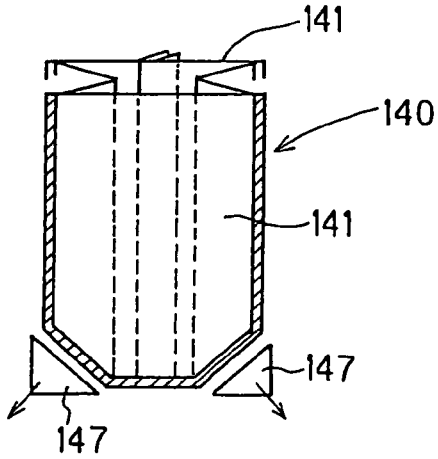

This packaging bag 140 is formed by steps shown in FIG. 19. First, as shown in FIG. 19A, a single sheet of film is folded and the folded end edges are bonded together, thereby forming a pair of flat surface portions 141, 141 and a pair of side surface portions 143, 143 having folding lines 144, 144. The portion formed by bonding both the end edges constitutes the fused portion 142 of the back surface portion 141. Thereafter, as shown in FIG. 19B, the boundary portions between the flat surface portions 141, 141 and the side surface portions 143, 143 are fused. By fusing the boundary portions, these fused portions 145 function as support columns of the bag. In this time, the lower portion of the tubular body is fused to be obliquely inclined downward. Thereafter, as shown in FIG. 19C, lower corner portions 147 of the fused portions 145 are cut away, thus completing the packaging bag 140 having the flat surface portions 141, 141 of hexagonal shape.

Figure 20A:
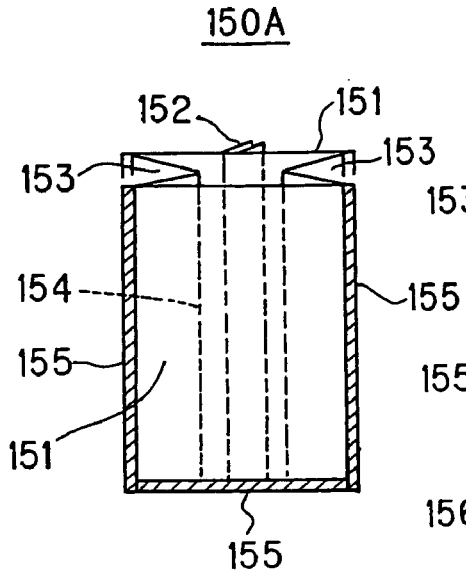
FIGS. 20A-B include views showing another example of the packaging bag.
Figure 20B:
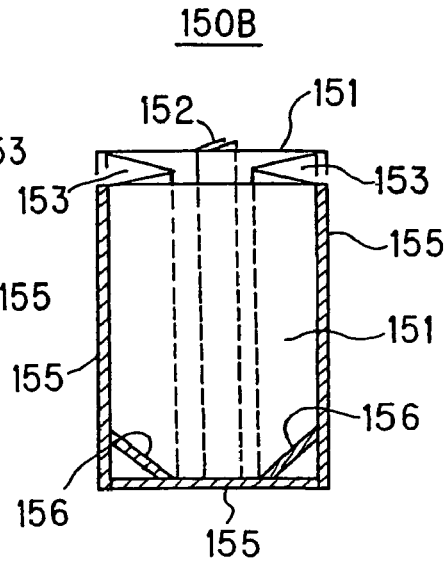
Figure 21:
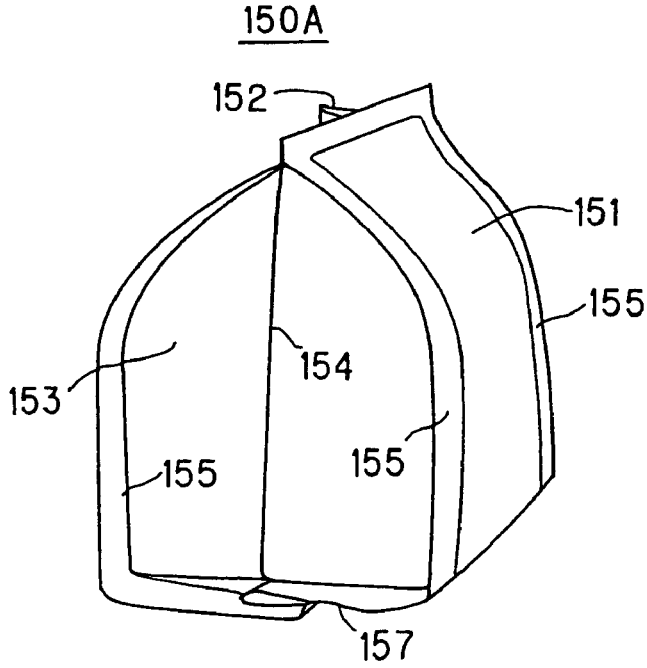
FIG. 21 is a perspective view showing a self-standing condition of the packaging bag shown in FIG. 20A.

FIG. 20 and FIG. 21 show a packaging bag according to another embodiment of the present invention. This packaging bag is also formed by bonding both end edges of a single sheet of film. In FIG. 20, two-types of packaging bags are shown. One of them shown in FIG. 20A includes a pair of opposed flat surface portions 151, 151 and a pair of side surface portions 153, 153 which are positioned between the side edge portions of the flat surface portions 151, 151. Each of the flat surface portions 151, 151 of this packaging bag 150A has a rectangular shape, and a fused portion 152 is formed by bonding a sheet of film, so as to project outward, to a back surface portion 151 forming one of the flat surface portions 151, 151. Folding lines 154, 154 are also formed to the central portions of the side surface portions 153, 153 to be directed inward of the packaging bag 150A. Fused portions 155 are also formed to boundary portions between the peripheral edges of the flat surface portions 151, 151 and the side surface portions 153, 153.

The other packaging bag 150B shown in FIG. 20B has a basic structure substantially the same as that of the packaging bag 150A. This packaging bag 150B is provided, at lower corner portions thereof, with fused portions 156, 156 extending obliquely so as to connect the side edges and a lower edge thereof. These fused portions are formed by boding the flat surface portion 151 and the side surface portions 153, 153 at the lower corner portions obliquely in shape of belt.

FIG. 21 shows the packaging bag 150A which is filled up with an inner content, and the upper end opening is then sealed. As shown in FIG. 21, the lower portions of the flat surface portions 151, 151 and side surface portions 153, 153 are folded so as to provide a bottom surface portion 157. The fused portions 155 function as support columns when the packaging bag 150A stands, thus improving the self-standing performance. Further, the packaging bag 150B has the same self-standing attitude as that of FIG. 12.

Figure 22:
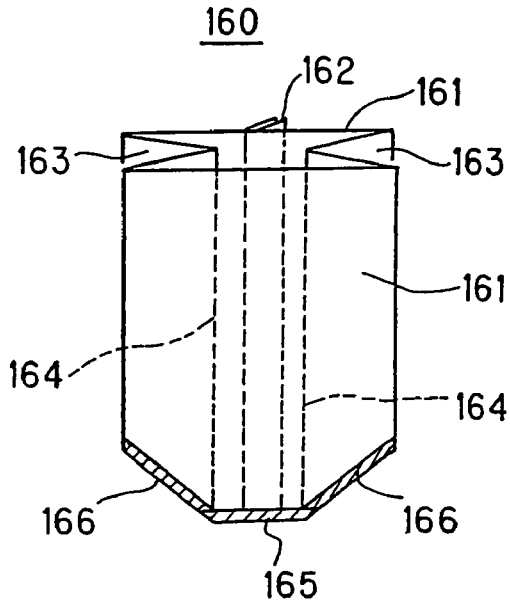
FIG. 22 is a view showing a further example of the packaging bag.
Figure 23:
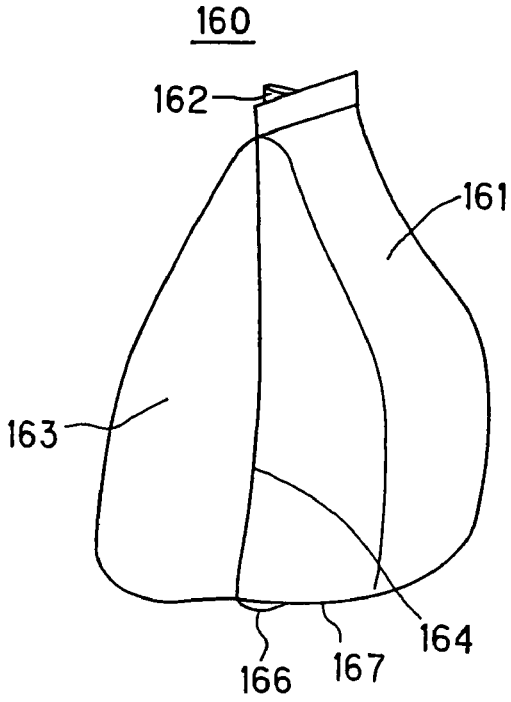
FIG. 23 is a perspective view showing a self-standing condition of the packaging bag shown in FIG. 22.

FIG. 22 and FIG. 23 represent a packaging bag according to a further embodiment of the present invention. The packaging bag 160 shown in FIG. 22 and FIG. 23 is a bag provided with no fused portion at the boundary portion between flat surface portions 161, 161 and side surface portions 163, 163. The packaging bag 160 is, as shown in FIG. 22, composed of a pair of opposed flat surface portions 161, 161 and a pair of side surface portions 163, 163 disposed between both side edges of the flat surface portions 161, 161.

A fused portion 162 is formed by bonding end edge portions of a sheet of film, so as to project outward, to a back surface portion 161 forming one of the flat surface portions 161, 161. The lower portions of the flat surface portions 161, 161 are formed into a hexagonal shape so as to provide a downward tapered shape. Both the side edges thereof extend vertically of the packaging bag in parallel with each other, and on the other hand, the upper and lower end edges thereof extend horizontally in parallel with each other. The lower corner portions of the flat surface portions 161, 161 are tapered downward, and oblique (downward inclined) portions 166, 166 connect the side edges and the lower edge, respectively. Furthermore, folding lines 164, 164 are formed to the vertically central portions of the side surface portions 163, 163 so as to fold the side surface portions 163, 163 inward of the packaging bag 160 along the folding lines 164, 164. The flat surface portions 161, 161 and the side surface portions 163, 163 are fused at their lower edges 165 and oblique portions 166, 166, thus closing the bottom surface portion of the packaging bag 160.

FIG. 23 shows the packaging bag 160 of FIG. 22 which is filled up with an inner content. After being filled up with the inner content, the upper edge of the packaging bag 160 is fused to seal the upper end opening thereof. The lower portions of the flat surface portions 161, 161 and side surface portions 163, 163 are folded so as to provide a bottom surface portion 167. This bottom portion 167 serves to provide the self-standing performance to the packaging bag 160.

The manufacturing method of this packaging bag 160 is substantially the same as the manufacturing method of the packaging bag 140 shown in FIG. 17 and FIG. 18 except that the former method includes no step of forming a fused portion between the boundary portions of the flat surface portions 161, 161 and the side surface portions 163, 163.

FIG. 24 and FIG. 23 represent packaging bags according to a further embodiment of the present invention, in which the boundary portion between the flat surface portion and side surface portion are not provided with any fused portion, and show two-types of packaging bags 170A and 170B as like as those in FIG. 20 and FIG. 21. One-type is shown in FIG. 24(*a*), which has no oblique fused portion at the lower portion of the packaging bag 170A, and the other one-type, i.e., packaging bag 170B, is provided with oblique fused portions 176, 176 at the lower portion thereof.

Figure 24A:
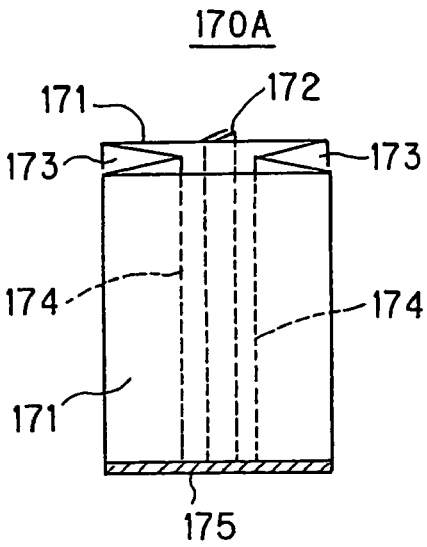
FIGS. 24A-B include views showing a further example of the packaging bag.

The packaging bag 170A shown in FIG. 24A includes a pair of opposed flat surface portions 171, 171 and a pair of side surface portions 173, 173 which are positioned between the side edge portions of the flat surface portions 171, 171. Each of the flat surface portions 171, 171 of this packaging bag 170A has a rectangular shape, and a fused portion 172 is formed by bonding a sheet of film, so as to project outward, to a back surface portion 171 forming one of the flat surface portions 171, 171. Folding lines 174, 174 are also formed to the central portions of the side surface portions 173, 173 to be directed inward of the packaging bag 170A. A fused portion 175 is formed, at the lower edge thereof, by bonding both lower edge of the flat surface portions 171, 171 so as to sandwich the side surface portions 173, 173, therebetween.

Figure 24B:
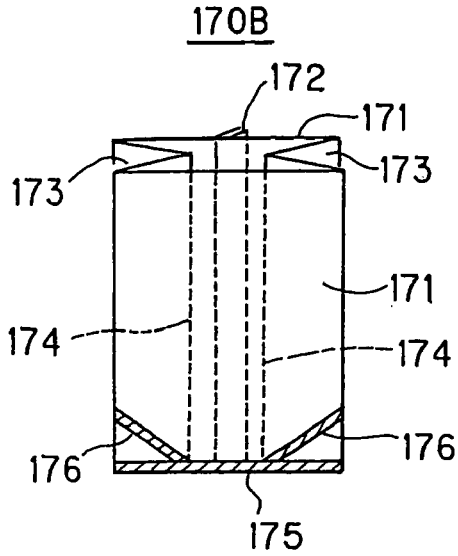

The other packaging bag 170B shown in FIG. 24B has a basic structure substantially the same as that of the packaging bag 170A. This packaging bag 170B is provided, at lower corner portions thereof, with fused portions 176, 176 extending obliquely so as to connect the side edges and a lower edge thereof. These fused portions are formed by boding the flat surface portion 171 and the side surface portions 173, 173 at the lower corner portions obliquely in shape of belt.

Figure 25:
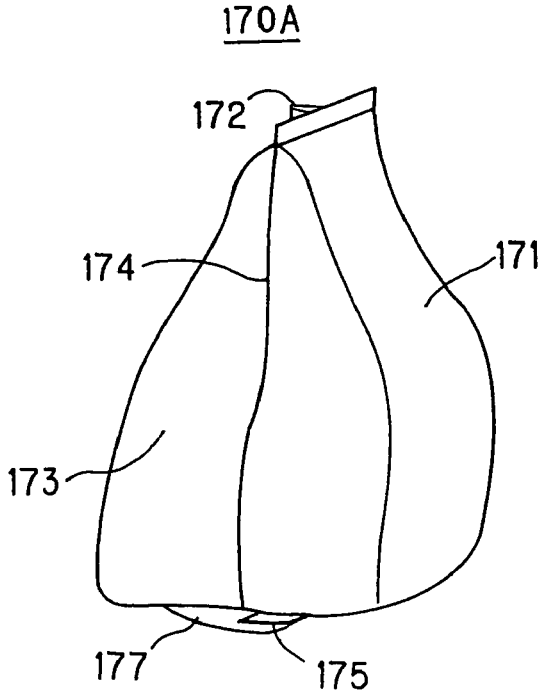
FIG. 25 is a perspective view showing a self-standing condition of the packaging bag shown in FIG. 24.

FIG. 25 shows the packaging bag 170A which is filled up with an inner content and the upper end opening is then sealed. The lower portions of the flat surface portions 171, 171 and the side surface portions 173, 173 are folded toward the center side of the packaging bag 170A from the lower edges thereof by a predetermined distance to thereby form a flat bottom portion, which functions as a bottom surface portion 177. The bottom surface portion 177 serves to stand the packaging bag 170A. The lower portion of the packaging bag 170B may function as the bottom surface portion and facilitate self-standing of the bag.

Figure 26:
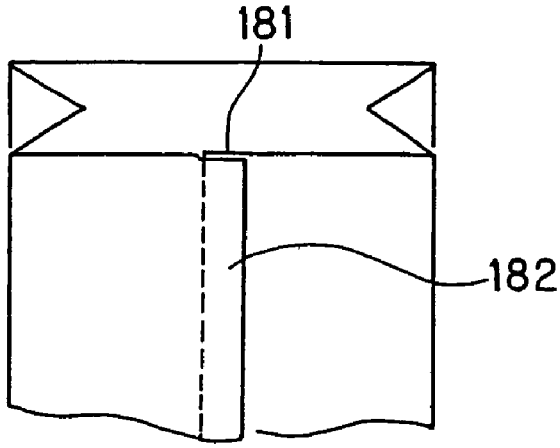
FIG. 26 shows one example in which end edge portions of a film forming a packaging bag are bonded together.
Figure 27:
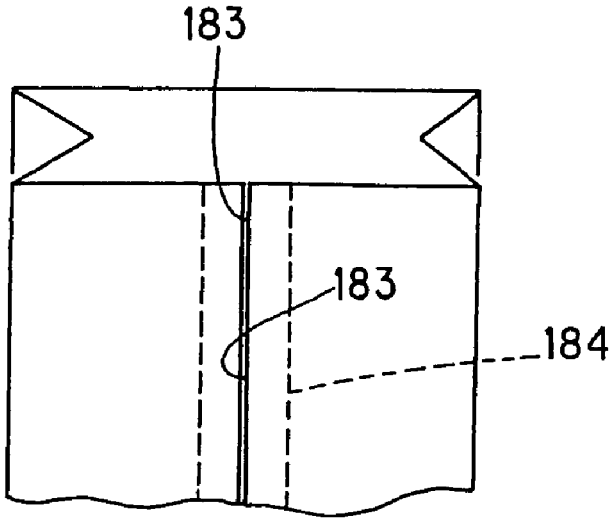
FIG. 27 shown one example in which end edge portions of a film are bonded together by means to tape.

Although there are described, with reference to FIGS. 17 to 25, embodiments in which, when forming the packaging bag from a sheet of film, the inner surfaces are opposed to each other and the end edges are bonded together, the present invention is not limited to such embodiments. There may be adopted embodiments or examples in which, as shown in FIG. 26, an outer surface of one end edge 181 of a film is fused to an inner surface of the other end edge 182, or as shown in FIG. 27, end edges 183 and 183 are abutted to each other, which are then bonded by means of tape 184.

Figure 9:
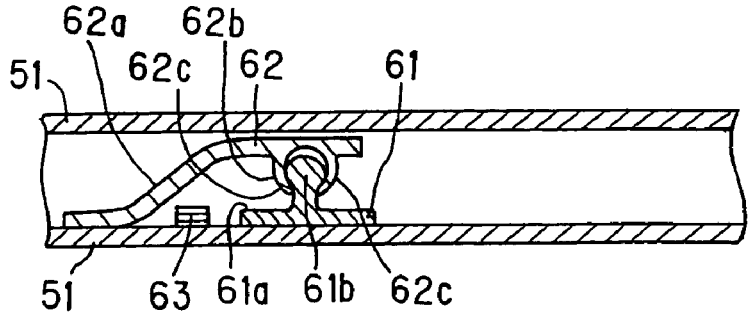
FIG. 9 is an enlarged sectional view showing a positional relationship between the fastener and the cut-tape.

Hereinabove, the embodiments in which the packaging bag is formed from a single sheet of film. As shown in FIG. 2 or FIG. 9, a fastener composed of male portion and female portion is attached to the inner surface of the flat surface portion or the inner surface of the side surface portion, and a cut-tape is also attached in parallel with the fastener. The attaching direction may be horizontal or vertical of the packaging bag. The fastener and the cut-tape may be otherwise attached in a manner inclined with respect to the end edge of the flat surface portion or side surface portion.

As mentioned above, according to the present invention, there can be obtained a gusset-type fastener bag which can be easily opened and re-closed. In addition, the fastener can be attached so as to extend in an optional direction in accordance with the kinds of content to be filled up. Moreover, since the position of an opening through which the content fills the packaging bag and the position at which the fastener is attached are made different, the opening can be made large or wide. Thus, the content can be effectively filled up with increased amount.

The invention claimed is:

1. A fastener bag comprising:

a pair of opposed flat surface portions, a pair of side surface portions located between both side edges of the flat surface portions, the side surface portions being folded inward so as to provide a gusset-type packaging bag, and a fastener for opening or closing the packaging bag located on an inner surface of one of the flat surface portions or side surface portions, fused portions located at boundaries of said flat surface portions and said side surface portions, said fused portions formed by bonding one of said flat surface portions and an adjacent side surface portion; and at least one non-fused portion located in a boundary of said flat surface portion and said side surface portion and surrounded by said fused portion, wherein said fastener comprises a male portion having a base portion located on one of said flat surface portions or said side surface portions, the base portion having a projected thread extending in a longitudinal direction, the fastener further comprising a female portion having a base portion located on one of said flat surface portions or said side surface portions, the base portion having an engaging groove detachably engaged with the projected thread to extend in a longitudinal direction, wherein the base portions of said male portion and said female portion are both bonded to a single one of said flat surface portions and said side surface portions, so that the projected thread and the engaging groove face each other, wherein a cut-tape is located between the base portion of the male portion and the base portion of the female portion on the flat surface portion or the side surface portion, and an end of the cut-tape is adjacent to the fused portion, wherein the flat surface portion or side surface portion on which the cut-tape is located has a tab portion for opening the bag at a position corresponding to at least one end in a length direction of the cut-tape by forming cut-in portions with the end of the cut-tape being the center thereof so that a portion of the cut-tape is separate from the flat surface portion or side surface portion, the tab portion located on the non-fused portion.

2. The fastener bag according to claim 1, wherein said pair of flat surface portions and said pair of side surface portions constitute a tubular bag body having both ends opened as end openings, one of the end openings of the bag body is closed by a bottom surface portion, and the bottom surface portion has a flat shape.

3. The fastener bag according to claim 1, wherein said fastener and said cut-tape extend in a horizontal direction of the fastener bag.

4. The fastener bag according to claim 1, wherein said fastener and said cut-tape extend in an oblique direction with respect to an end edge of the flat surface portion or side surface portion on which the fastener and the cut-tape are located.

5. A fastener bag comprising:

a pair of opposed flat surface portions, a pair of side surface portions located between both side edges of the flat surface portions, the side surface portions being folded inward to provide a gusset-type packaging bag, a bottom surface portion having a flat shape, a fastener for opening or closing the packaging bag, the fastener located on an inner surface of at least one of the flat surface portions or the side surface portions, fused portions located at boundaries of said flat surface portions, said side surface portions, and said bottom surface portion, said fused portions formed by bonding one of said flat side portions, or bottom surface portions to an adjacent flat or side surface portion; and at least one non-fused portion located in a boundary of at least one of said flat surface portion, said side surface portion, and said bottom surface portion, said non-fused portion being surrounded by said fused portion, wherein said pair of flat surface portions and said pair of side surface portions constitute a tubular bag body having two end openings, one of the end openings of the bag body being closed by said bottom surface portion, said bag body being fused to said bottom surface portion at boundary portions of the bag body and the bottom surface portion by bonding the bag body and the bottom surface portion, wherein said fastener comprises a male portion having a base portion located on one of said flat surface portions or said side surface portions, the base portion having a projected thread extending in a longitudinal direction, the fastener further comprising a female portion having a base portion located on one of said flat surface portions or said side surface portions, the base portion having an engaging groove detachably engaged with the projected thread to extend in a longitudinal direction, wherein the base portions of said male portion and said female portion are both bonded to a single one of said flat surface portions and said side surface portions, so that the projected thread and the engaging groove face each other, wherein a cut-tape is located between the base portion of the male portion and the base portion of the female portion on the flat surface portion or the side surface portion, wherein the flat surface portion or side surface portion on which the cut-tape is located has a tab portion for opening the bag at a position corresponding to at least one end of the cut-tape by forming cut-in portions with the end of the cut-tape being the center thereof so that a portion of the cut-tape is separate from the flat surface portion or side surface portion, the tab portion located on the non-fused portion.

6. The fastener bag according to claim 5, wherein said fastener and said cut-tape extend in a vertical direction of the fastener bag.

7. The fastener bag according to claim 5, wherein said fastener and said cut-tape extend in an oblique direction with respect to an end edge of the flat surface portion or side surface portion on which the fastener and the cut-tape are located.

* * * * *